US006871368B2

(12) United States Patent
Calkin

(10) Patent No.: US 6,871,368 B2
(45) Date of Patent: Mar. 29, 2005

(54) EMERGENCY DRAG STRETCHER

(76) Inventor: Carston R. Calkin, P.O. Box 230487, Portland, OR (US) 97281

( * ) Notice: Subject to any disclaimer, the term of this patent is extended or adjusted under 35 U.S.C. 154(b) by 0 days.

(21) Appl. No.: 10/660,177

(22) Filed: Sep. 10, 2003

(65) Prior Publication Data

US 2004/0088794 A1 May 13, 2004

Related U.S. Application Data

(60) Provisional application No. 60/409,445, filed on Sep. 10, 2002.

(51) Int. Cl.[7] ..... A61G 1/013

(52) U.S. Cl. ..... 5/628; 5/627; 5/625

(58) Field of Search ..... 5/628, 627, 625, 5/89.1, 81.1 R, 81.1 T; 294/140; 128/869, 870

(56) References Cited

U.S. PATENT DOCUMENTS

| | | | | | |
|---|---|---|---|---|---|
| 722,456 | A | * | 3/1903 | Reeves | 5/627 |
| 2,279,694 | A | * | 4/1942 | Martinson | 5/627 |
| 2,410,181 | A | * | 10/1946 | Peters | 5/628 |
| 2,489,828 | A | * | 11/1949 | Springer | 5/628 |
| 2,788,530 | A | * | 4/1957 | Ferguson | 5/628 |
| 2,899,692 | A | * | 8/1959 | Finken | 5/628 |
| 3,158,875 | A | * | 12/1964 | Fletcher | 5/628 |
| 4,124,908 | A | * | 11/1978 | Burns et al. | 5/628 |
| 4,211,218 | A | * | 7/1980 | Kendrick | 602/19 |
| 4,601,075 | A | * | 7/1986 | Smith | 5/628 |
| 4,665,908 | A | * | 5/1987 | Calkin | 128/870 |
| 4,776,327 | A | * | 10/1988 | Russell | 602/5 |
| 4,970,739 | A | * | 11/1990 | Bradford | 5/625 |
| 5,027,833 | A | * | 7/1991 | Calkin | 128/870 |
| 5,044,031 | A | * | 9/1991 | Sherwood et al. | 2/69.5 |
| 5,050,254 | A | * | 9/1991 | Murphy | 5/625 |
| 5,058,575 | A | * | 10/1991 | Anderson | 602/18 |
| 5,121,514 | A | * | 6/1992 | Rosane | 5/628 |
| 5,189,746 | A | * | 3/1993 | Horie | 5/627 |
| 5,701,619 | A | * | 12/1997 | Ullman | 5/625 |
| 5,720,303 | A | * | 2/1998 | Richardson | 128/870 |
| 5,729,850 | A | * | 3/1998 | Eskeli | 5/621 |
| 5,787,529 | A | * | 8/1998 | Landes | 5/628 |
| 5,839,137 | A | * | 11/1998 | Butler et al. | 5/627 |
| 5,978,989 | A | * | 11/1999 | Chavez | 5/627 |
| 6,634,044 | B1 | * | 10/2003 | Wright | 5/625 |
| 2004/0088794 | A1 | * | 5/2004 | Calkin | 5/628 |

FOREIGN PATENT DOCUMENTS

| | | | | | |
|---|---|---|---|---|---|
| DE | 522691 | A | * | 4/1931 | 5/628 |
| FR | 1147653 | A | * | 11/1957 | 5/627 |
| GB | 2157574 | A | * | 10/1985 | A61G/1/00 |
| GB | 2157957 | A | * | 11/1985 | A61G/1/00 |

* cited by examiner

*Primary Examiner*—Robert G. Santos
(74) *Attorney, Agent, or Firm*—Olson & Olson

(57) ABSTRACT

A flexible drag stretcher is arranged for storage and transport in a tightly rolled, compact cylindrical storage condition for hand carrying and for mounting on the backpacks of soldiers and hikers, for unrolling of the stretcher into an operative stretcher condition arranged to protectively secure an injured person thereon for emergency drag removal from the scene of an injury by one or more persons, the stretcher having a single center base panel formed of a flexible sheet material and mounting a pair of opposite, flexible side torso flap members arranged to be snugly cinched against the sides of only the torso portion of an injured person's body, whereby to secure the patient to the stretcher during operation of the stretcher.

4 Claims, 6 Drawing Sheets

EMERGENCY DRAG STRETCHER

This application claims benefit under 35 U.S.C. 119(e) of the priority filing of U.S. Provisional application Ser. No. 60/409,445, Filed 10 Sep. 2002.

BACKGROUND OF THE INVENTION

This invention relates to stretchers for emergency extrication of injured persons from the scene of an injury and more particularly to emergency drag stretchers that are arranged primarily to secure a person for drag extrication from a dangerous scene by one or more people.

Referring primarily to military battlefield injury situations, it is invariably of greatest importance to quickly remove the injured soldier from the immediate scene of his injury because of the extreme peril of additional injury or death due to the danger present at that particular location. However, in most cases valuable time is lost waiting for specialized personnel to bring stretchers and litters from rearward positions to the injured man since, by virtue of their large and bulky size, stretchers and litters are typically too awkward for frontline soldiers to carry with them as part of the standard equipment they carry. There is therefore a need for a stretcher apparatus specifically arranged for primary use in emergency situations where the immediate removal of an injured person from a danger scene is of primary importance for the safety of the injured person as well as that of his rescuer, as for example in battlefield situations, building collapses and other disaster situations involving mass casualties, as well as many other situations.

SUMMARY OF THE INVENTION

In its basic concept, this invention provides an emergency drag stretcher formed of flexible sheet material providing an underlying center panel having separate, side torso flap members secured thereto by flexible hinges for partially encircling and securing the torso portion of an injured person to the drag stretcher, the drag stretcher also arranged to be rolled into a compact, lightweight cylindrical storage condition dimensioned for carried support on a soldier's backpack and for easy hand carrying into tight, awkward, confined spaces which may otherwise be inaccessible to standard, full length rescue stretchers.

It is by virtue of the foregoing basic concept that the principal objective of this invention is achieved; namely, the provision of an emergency drag stretcher that overcomes the limitations and disadvantages of stretchers of the prior art.

Another objective and advantage of this invention is the provision of an emergency drag stretcher of the class described which may, in one form, be provided for underlying and supporting only the head and torso portion of a patient for particularly compact storage and transport, and which may, when two of such stretchers are secured together end to end, support the entire length of an injured person, or in another form of the invention, be arranged to accommodate the full length of a person.

Another object and advantage of this invention is the provision of an emergency drag stretcher of the class described which may be rolled tightly into a compact, lightweight storage condition for attachment to and carrying on a backpack used by soldiers, hikers and rescue personnel.

A further object and advantage of this invention is the provision of an emergency drag stretcher of the class described which is of simplified construction for economical manufacture and reliability of use.

The foregoing and other objects and advantages of the present invention will appear from the following detailed description, taken in connection with the accompanying drawings of preferred embodiments.

DESCRIPTION OF THE PREFERRED EMBODIMENTS

Figure 1:
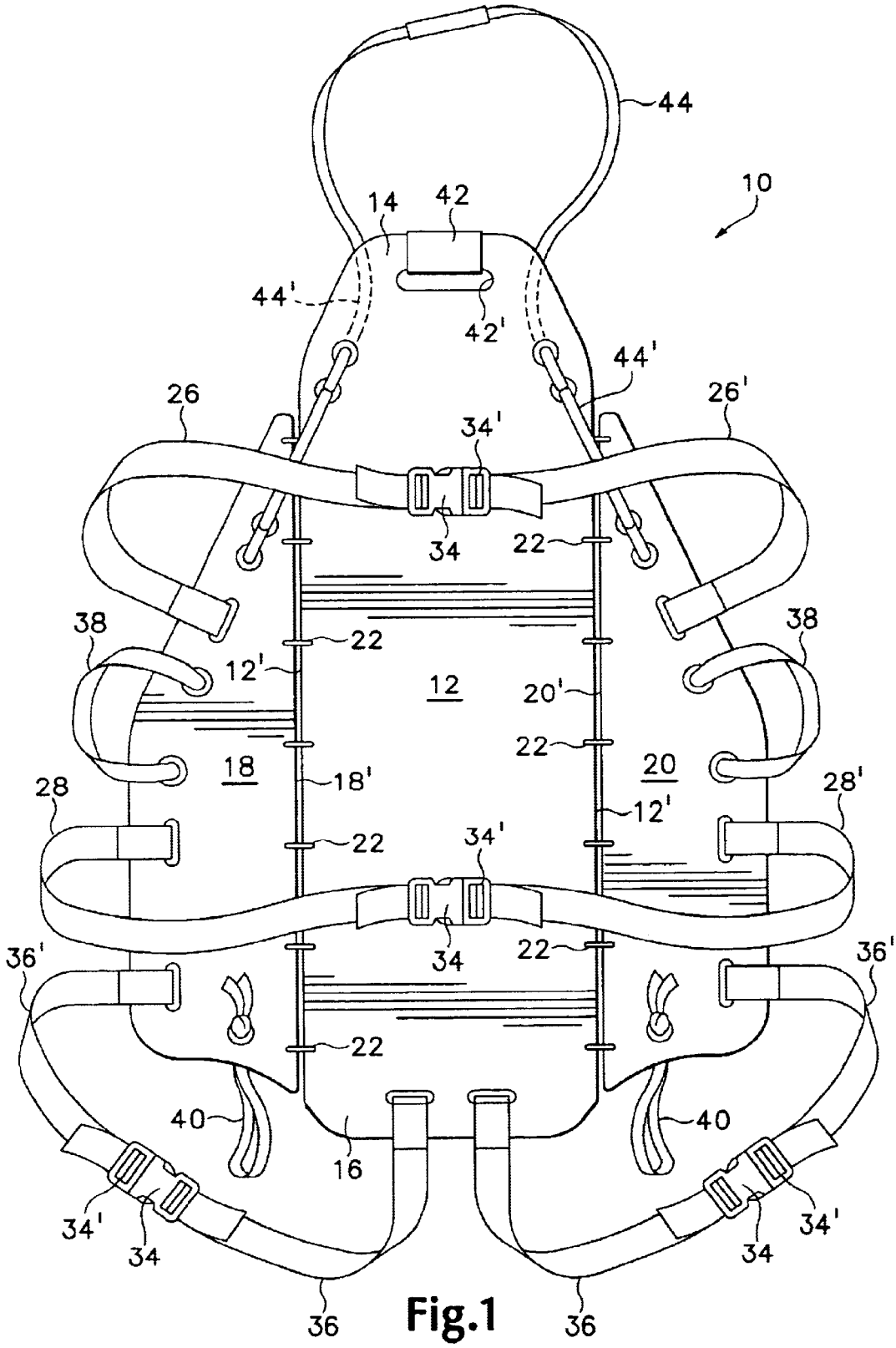
FIG. 1 is a top plan view of a first embodiment of a drag stretcher embodying features of this invention and shown with the side torso flap members in an open condition preliminary to placement of an injured person onto the base center panel for securement.
Figure 2:
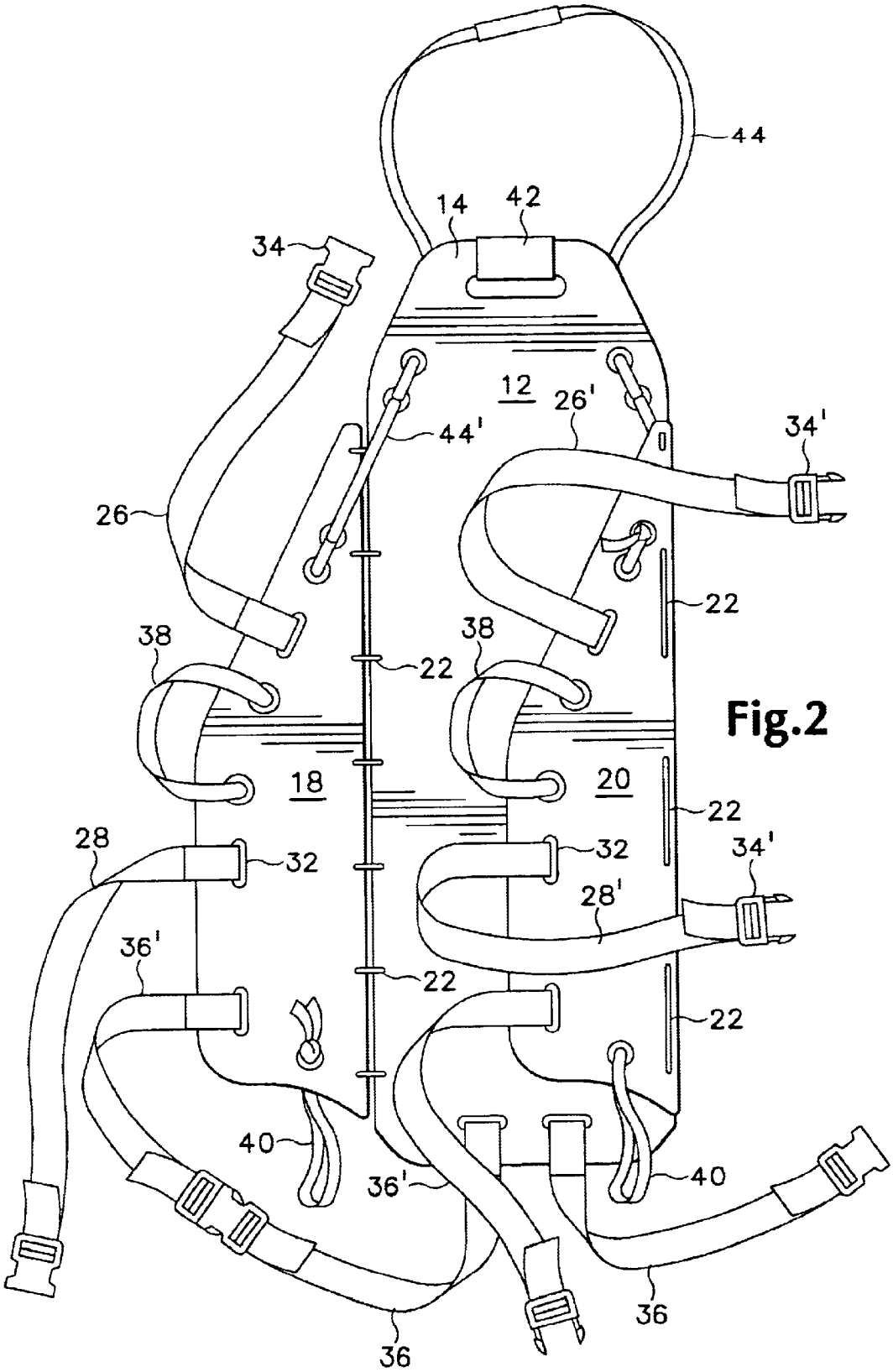
FIG. 2 is a top plan view of the drag stretcher of FIG. 1 but shown with one side torso flap member pivoted into collapsed, storage condition to illustrate the pivoting movement of the flexibly hinged side torso flap members.

FIGS. 1 and 2 illustrate the basic structure of the present invention as shown in connection with a first embodiment of an emergency drag stretcher. As seen in FIG. 1, a drag stretcher embodying features of this invention includes a generally rectangular base panel 12 having a first front longitudinal head end 14 and a second, rear longitudinal end 16. In the first embodiment illustrated, the base panel 12 has a length of approximately 48 inches and a width of approximately 18 inches in order to receive and support substantially the entire length of the head and torso of a person disposed thereon.

The base panel 12 and side torso flap panels yet to be described are preferably formed of synthetic thermoplastic resin material selected for durability, relative hardness and desired flexibility. The panels formed of the selected material are extremely resistant to damage from cutting, scarring, denting, breaking and deforming over its surface, and yet possess sufficient flexibility to permit the panels to be rolled into a tight, lightweight cylinder-like roll condition for purposes which will become clear.

As illustrated, a pair of opposite, side torso flap panels 18, 20 are each configured with a longitudinally-extending, lateral side edge 18', 20' arranged for flexible, hinged securement to the base panel 12. In the embodiment illustrated, flexible hinge securement means is provided by lengths of flexible cable 22 or other elongate cord-like material woven through corresponding spaced-apart bores (not shown) provided inwardly of and extending along the confronting lateral side edges 12', 18' 20' of the base panel 12 and the side flap panels 18, 20 respectively. In this manner, each of the opposite side flap panels 18, 20 may be pivoted about its respective hinged attachment along the lateral sides of the base panel 12 as can be seen in FIG. 2 of the drawings.

As will be apparent to those skilled in the art, the flexible, pivoting, hinge securement of the side flap panels to the base panel permits each of the side panels to be pivoted into a collapsed condition freely overlying the base panel 12 as indicated by the panel on the right in FIG. 2. In this condition the entire stretcher is approximately 18 inches wide and by virtue of the flexible hinge arrangement, can be tightly rolled from one longitudinal end to the other into the compact, cylinder-like storage condition seen in FIG. 5 and contained in an enclosing storage bag 24 for mounting on a soldier's backpack as shown. In this manner, any number of soldiers can carry the stretcher of this invention on their backpacks substantially without any negative impact on the soldier's mobility, performance or inconvenience.

Figures 4, 5:
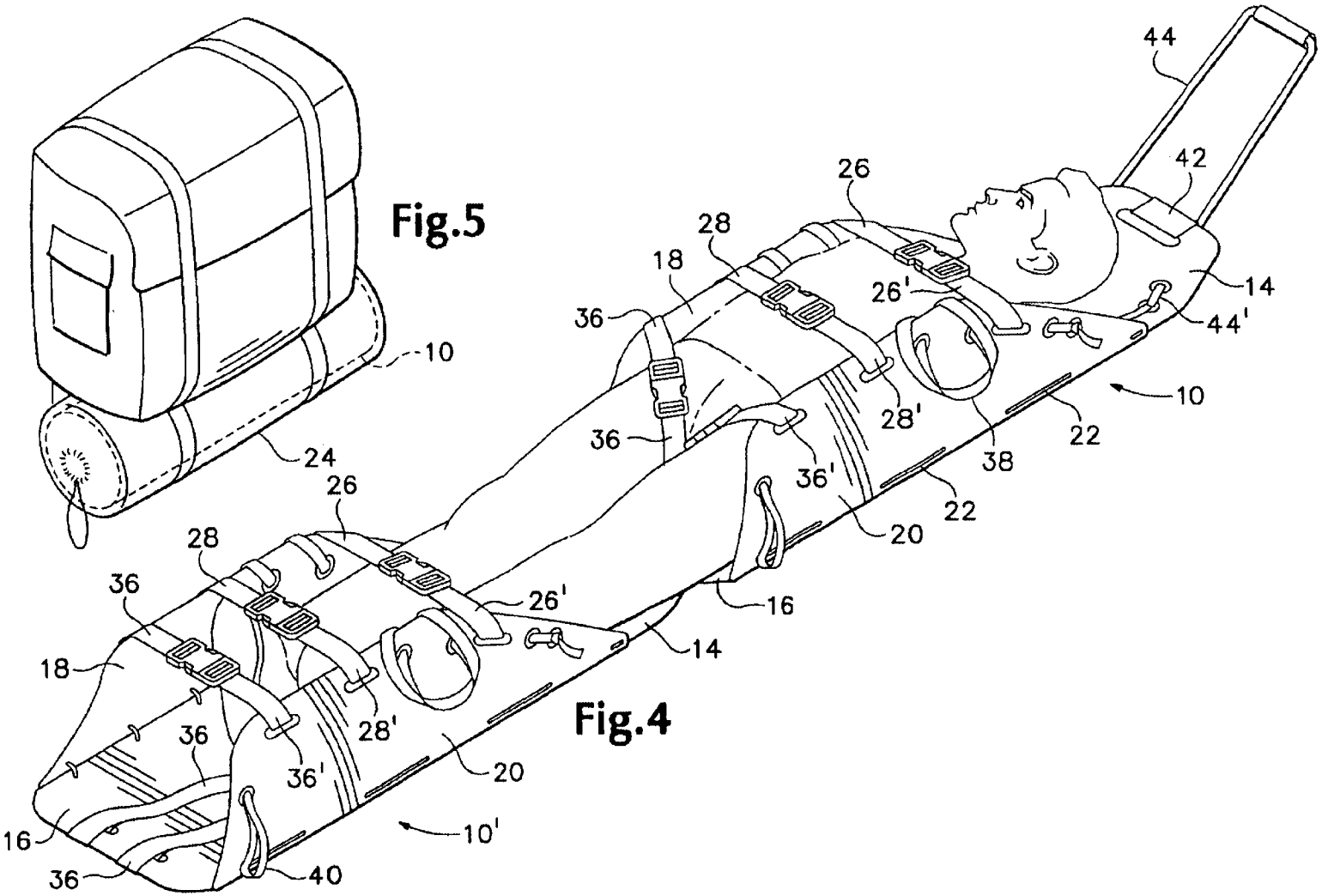
FIG. 4 is a perspective view of the assembly of FIG. 3 operatively supporting an injured person for dragged extraction from the site of an injury.
FIG. 5 is a perspective view of the drag stretcher of this invention in tightly rolled, storage condition contained within a protective bag and secured on a backpack for carried transport.

As will be readily apparent to those skilled in the art, with the stretcher lying on the ground and with the side panels 18, 20 pivoted into their spread apart condition of FIG. 1, (and with the yet to be described straps pulled away from the top surface of the stretcher), an injured soldier may be placed on the base panel 12 and the side flap panels pivoted arcuately on their hinges into the condition of FIG. 4 in which they extend upwardly alongside the torso body portion of the injured soldier, protectively confining his arms and torso on the stretcher between the flap members.

Means for snuggly securing the flap members together against the sides of an injured person are provided herein as flexible strap members, preferably formed of webbing for strength and durability, and provided to releasably interengage the opposite side flap members 18, 20 to adjustably and cinchably secure them together to protectively secure and contain an injured person on the stretcher therebetween, as seen in the upper right portion of FIG. 4. In this embodiment, strap members 26, 26' and 28, 28' are each secured at one of their ends to spaced-apart points along the length of respective side flap panels 18, 20. One way of securing the strap ends is shown herein and provides slots 30, 32 through the side flap panels at spaced apart points along the length of the flap members. The strap members engage the slots through a closed loop formed at their terminal ends. Alternatively of course, the strap ends may be secured onto the flap members by any other suitable means as may be desired, such as by either fixedly or releasably securing the straps to the side flaps by riveting, screwing or by releasable loop interconnection if preferred. As shown, the strap members 26, 26', 28, 28' are preferably positioned to fall across the upper and mid torso area, respectively, of a person supported on the stretcher, as also seen in FIG. 4.

The opposite, corresponding ends of the strap members are provided for releasable interengagement with each other as by the releasable buckle components 34, 34' shown. Preferably this interconnection also provides for adjustment of the length of the strap members between buckle components whereby the straps may be connected together adjustably, so as to accommodate for persons of different size and bulk, and to permit desired variations of how snuggly the side flap panels are drawn against the patient. In this manner a person may be secured as tightly as needed to secure him safely while still safely accommodating as necessary for his particular injuries.

Also, and importantly, the stretcher of this embodiment of the invention includes groin strap members 36, 36' secured respectively to the rear longitudinal end 16 of the base panel and to the opposite side flap panels 18, 20 as shown. Each strap member 36, 36' is also arranged for releasable and adjustable securement to each other as by the buckle members 34, 34' described earlier.

As will be apparent in viewing FIG. 4, the groin strap members 36 are secured adjacent the terminal end 16 of the base panel 12 in position so that they may be drawn upwardly between the legs of a patient adjacent the crotch, while the corresponding strap members 36' are secured to the side flap panels forwardly of the rear end 16 of the base panel. In this manner, when the straps 36, 36' are fastened (as by buckle components 34, 34') and adjusted for proper tension, the patient is secured against rearward sliding movement off of the stretcher as it is dragged or carried, even in a vertical, suspended orientation.

The drag stretcher of this invention preferably includes means for facilitating the lifting and carrying of the stretcher with an injured person secured therein. In the embodiment illustrated, the side flap panels 18, 20 further mount handle members, illustrated herein as lifting straps 38, 40, secured in position to permit lifting and carrying of the stretcher and patient by persons at the opposite sides of the stretcher. A lifting handle 42 is also preferably provided (as by the open slot 42' provided) at the front, head end 14 of the stretcher as shown whereby the stretcher may also be lifted by person's at the opposite ends using handle 42 and straps 40 if desired. This form of the invention also permits the patient to bend freely at the hips while secured to the stretcher, facilitating extrication from confined places and where tight turns must be navigated.

In order to facilitate the removal of an injured person from the immediate scene by a sole rescuer tending him, the drag stretcher of this invention also preferably includes a drag strap member 44 secured to the stretcher forming an elongate loop extending from the front end 14 of the stretcher for hand grasping and pulling upon by a person to drag the stretcher and patient thereon behind him. In the preferred embodiment illustrated, the drag strap member 44 is preferably formed of web material and configured with opposite end length sections 44' to engage both the forward end portion 14 of the base panel 12 and the forward end portions of each opposite side panel 18, 20 as seen best in FIGS. 1 and 2. As shown, the opposite end lengths 44' are trained through a plurality of bores 46 provided through the base panel and opposite side flap panels and secured there as by the tying arrangement 48, 48' shown in FIG. 2. In this manner, when the loop portion 44 is pulled upon, the strap ends 44' pull substantially equally on both the base panel 12 and each opposite side panel 18, 20, thereby effectively distributing the pulling force about the entire forward end of the stretcher and thus stabilizing it under pull so that it follows in a substantially uniform, straight line condition as it is dragged over the ground.

From the foregoing description of the basic structure of the drag stretcher of this invention, its use and operation is readily apparent: When a soldier is injured, one of his comrade soldiers may become immediate rescue personnel by removing the drag stretcher roll from its mount on his backpack (FIG. 5) and withdraw the stretcher 10 from its protective carrying bag 24. He unrolls the stretcher and reverse bends it so that it will assume and maintain a substantially flat condition when laid on a ground surface. The side panels 18, 20 are pivoted into their spread apart condition of FIG. 1 and the straps 26, 26', 28, 28', 36, 36' are put into unfastened condition and clear of the upwardly facing panels 12, 18 and 20. The patient is then lain on the base panel 12 and the side flap panels 18, 20 are pivoted upwardly alongside the patient's sides, whereupon the respective strap members are secured together and adjusted as needed to confine the patient securely for transport. The groin straps are secured and adjusted similarly. Thus confined, the patient is ready for transport and the rescuer may grab the drag strap 44 and drag his injured comrade to safety. As mentioned previously, the stretcher and patient may be lifted by personnel using the various lifting straps 38, 40, 42 as is readily apparent.

As those skilled in the art will recognize, when the side flap members 18, 20 are pivoted into their patient-enclosing condition and strapped together as described hereinbefore, they extend substantially perpendicularly from their hinged securement to the base panel 12 as seen most clearly in FIG. 4. In this condition, it can be readily recognized that when the structure is in operative, patient-supporting condition, the upwardly-extending side flap panels 18 and 20 form a rigid, strong, generally right-angle joint with the base panel which serves to rigidify the bottom base panel 12 along its length and thereby substantially eliminate undesirable bending of the base panel under the weight of the patient as the stretcher is pulled over uneven ground surfaces and when it is lifted and carried.

Figure 3:
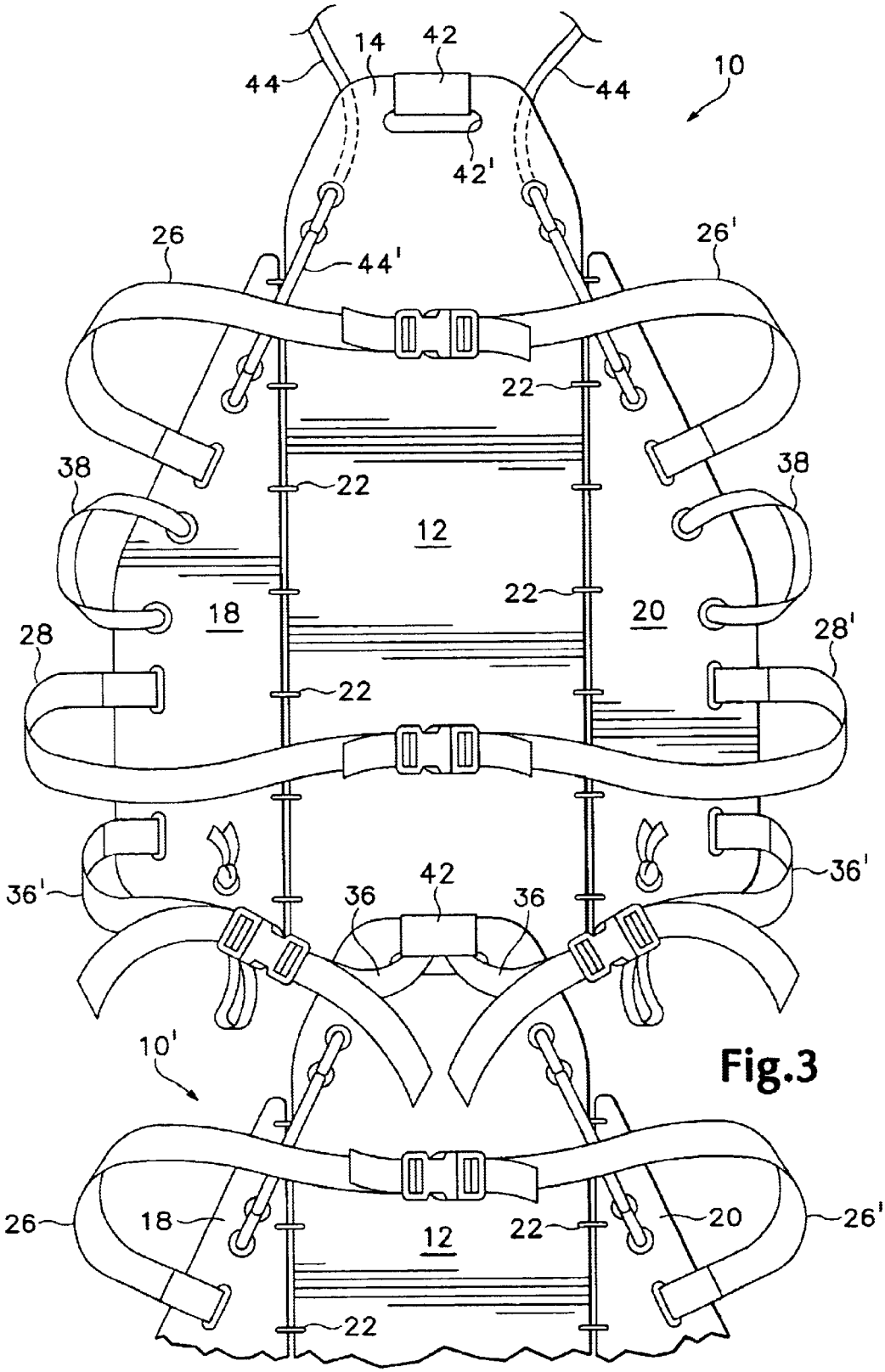
FIG. 3 is a fragmentary top plan view of the drag stretcher of FIG. 1 showing a second, identical drag stretcher attached thereto to form a substantially full length stretcher assembly for supporting the entire length of an injured person.

Finally, if time and conditions allow, or if the injured person has severe leg injuries requiring that they be protected during dragging of the stretcher, the drag stretcher of this particular embodiment may also be connected to a second, identical drag stretcher as shown in FIGS. 3 and 4 forming a full-length stretcher so that the entire length of the injured person may be supported for dragging. In this regard, a second, identical drag stretcher 10' of this invention is provided off of the backpack of a second soldier in the field and positioned in longitudinal alignment with a first drag stretcher 10 with the front end 14 of the second stretcher positioned immediately adjacent the rear end 16 of the first stretcher. The groin strap members 36 of the first stretcher are inserted through the handle slot 42' of the second stretcher 10'. It will be noted that the mounted positioning of the groin straps 36 on the rear end 16 of the stretcher permits substantially aligned passage of the straps through the handle slot 42.

The patient is then placed on the stretcher 10 as described hereinbefore with his legs extending on top of the second stretcher 10' and the torso strap members and groin strap members are then fastened as previously described. The side flap panel straps of the second stretcher are also connected together as shown to secure the patient's legs in confined condition on the second stretcher. With the stretchers thus connected together by the groin straps that are serving to also secure the patient on the forward stretcher, the two stretchers will be pulled together thus protecting the patient's entire body while being dragged. As can also be appreciated in viewing FIG. 3, in the connected condition shown without a patient, the stretchers can also be used if desired as a drag sled for carrying materials and equipment when other methods of transportation are not available.

Figure 6:
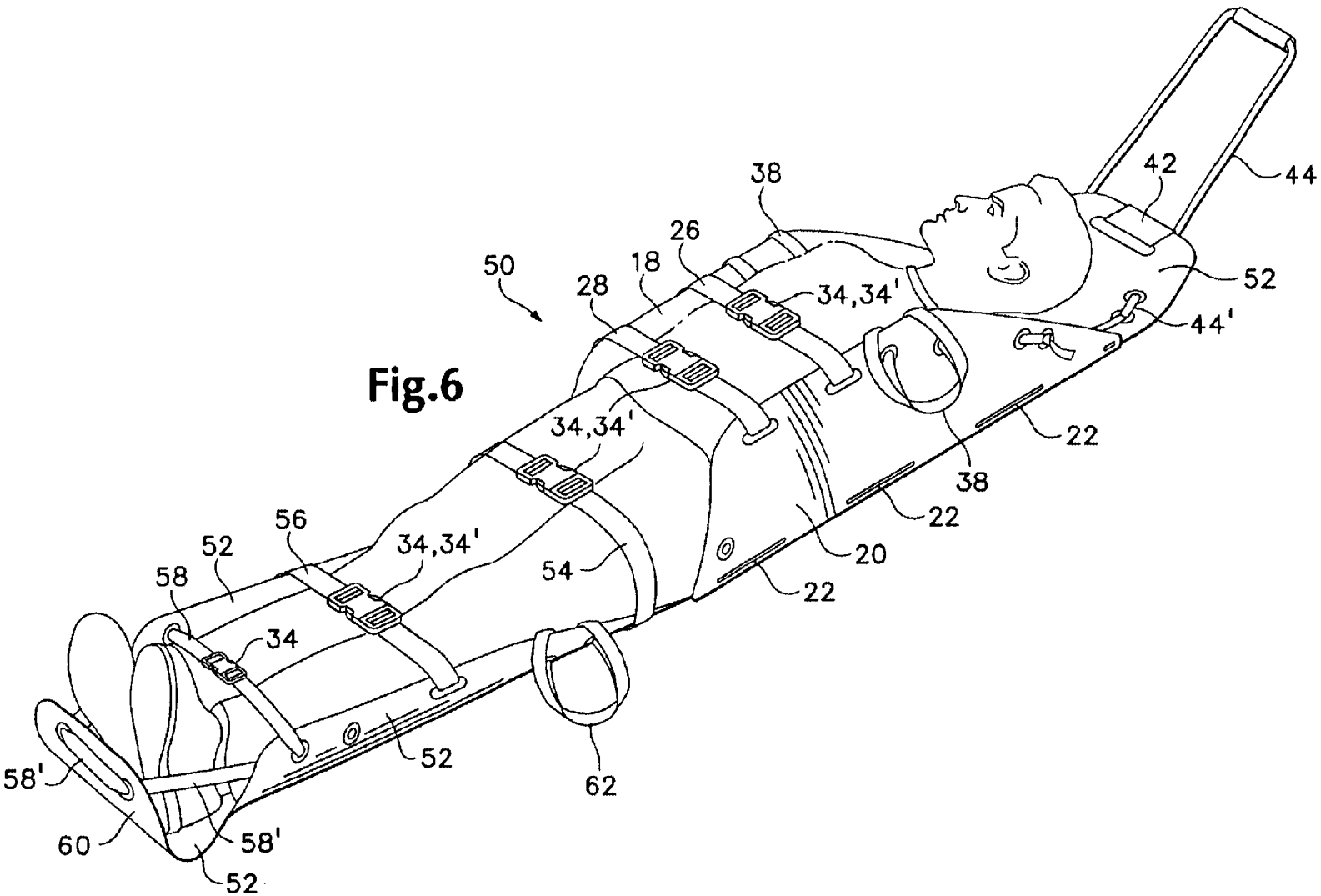
FIG. 6 is a perspective view of a second embodiment of a drag stretcher embodying features of this invention in use with an injured person secured thereto.
Figure 7:
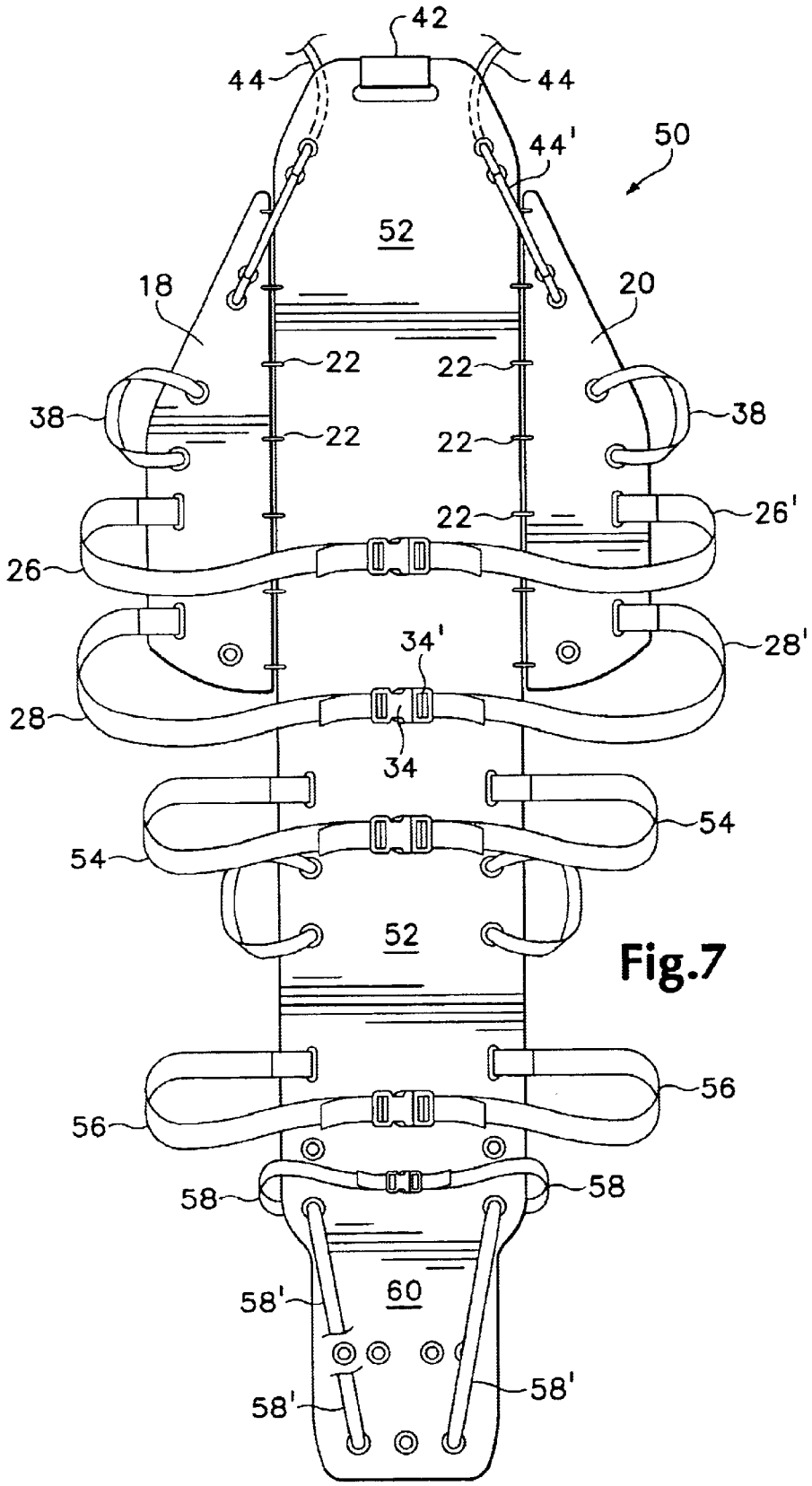
FIG. 7 is a top plan view of the stretcher of FIG. 6 shown in open condition preliminary to placement of a patient thereon.

Continued development and experimentation has revealed that the drag stretcher construction of this invention may be provided in a full length form with only slight increase in the diameter of the cylindrical roll of the drag stretcher in its rolled, transport condition and with only a nominal increase in its overall weight. In this, a second embodiment of a drag stretcher 50 embodying the basic features of this invention is illustrated in FIG. 6 wherein the only substantial modification to the previously described stretcher construction is that the base, center panel 52 (12 in the previous embodiment) is elongated in its longitudinal direction from an approximate 48 inch length to an overall length of approximately 84 inches in the case of the particular embodiment illustrated. The width of the center panel remains unchanged, as do the side torso flap members 18, 20; flexible hinges 22 and the various patient straps 26–28, lifting straps 38–42 and stretcher pull straps 44 and related structures all heretofore described. The groin straps 36 and related mounts therefor may if desired be provided at the base of the torso portion of the center panel (intermediate its longitudinal ends), as is understood from the embodiments of FIGS. 1 and 2 of the drawings, or alternatively the groin straps may be omitted entirely in this embodiment.

As is apparent in FIG. 6, the base center panel 52 is configured to extend beneath the head, torso, legs and feet of a patient disposed thereon and may mount, as illustrated in the embodiment of FIG. 6, adjustable thigh and calf leg straps 54, 56 arranged to be fastened, as by previously described buckle members 34, in tensioned engagement overlying the corresponding portions of a patient's legs. Ankle-level leg straps 58 may also be similarly provided, as shown, which, when in tensioned engagement, draws the lateral side edges of the base center panel 52 upward and against the outer sides of the lower legs as illustrated, effectively securing the legs together and also serving to help rigidify the leg portion of the stretcher against flexing in its longitudinal direction, as will be apparent to those skilled in the art. This arrangement, by tensionably securing the legs together also serves to provide an effective, emergency splinting of the legs, one with the other, when the patient is secured on the stretcher.

Also as illustrated, the base center panel 52 may be configured with a length sufficient to extend beyond the feet of a reclining patient, forming a tail lip portion 60 which may be provided, as by extended portions 58' of ankle-level leg straps 58 shown herein, for tensioned upturning at the base of the feet of the patient. This upwardly-extending arrangement of the terminal end of the drag stretcher rigidifies the terminal end portion in its lateral direction to assist in preventing unrestricted twisting and torqueing of the lower portion of the stretcher during dragging over uneven ground surfaces and during lifting of the stretcher by rescue personnel. Additional lifting straps 62 may be provided as shown to assist in the lifting of the elongated stretcher assembly and patient when needed.

It will be obvious to those skilled in the art that various changes other than those already described can be made in the size, shape, type, number and arrangement of parts described hereinbefore without departing from the spirit of this invention and the scope of the appended claims.

Having thus described my invention and the manner in which it may be used, I claim:

1. A flexible drag stretcher arranged for storage and transport in a tightly rolled, compact cylindrical storage condition and for unrolling into an operative, elongated stretcher condition for protectively securing an injured person positioned in a reclining condition thereon for dragged extrication from the scene of an injury, the drag stretcher comprising:

a) a longitudinally elongated flexible center base panel comprising a longitudinally elongated flexible sheet formed of a selected flexible synthetic thermoplastic resin material and defined by opposite longitudinal head and base ends and opposite lateral side edges, said center base panel having a selected overall length sufficient to underlie at least the entire length of the head and torso body portion of a person positioned in a reclining condition thereon, said center base panel having sufficient flexibility to allow the center base panel to be rolled in its longitudinal direction into a tightly rolled, compact, cylindical storage condition having an overall cylinder length approximatly equal to the width of the center base panel between said opposite lateral side edges thereof, b) a longitudinally elongated, flexible side torso flap member associated with each opposite lateral side edge of the center base panel, each said flap member comprising a longitudinally elongated sheet formed of a selected, flexible synthetic thermoplastic resin material and having a longitudinally extending lateral side edge arranged for confronting disposition along a portion of the length of a corresponding lateral side edge of said center base panel, each side torso flap member configured for engaging only the torso body portion of a person positioned in a reclining condition on the underlying center base panel, each said side torso flap member having sufficient flexibility to allow rolling of the flap member in the direction of the longitudinally extending laterial side edge thereof, c) flexible hinge means for interconnecting said center base panel and said side torso flap members in connected but separated condition, for free pivoting movement of said side torso flap members about an axis extending substantially along the confronting edges of said flap members with said lateral side edges of the center base panel, for hinged movement of the flap members between a folded, storage position freely overlying and substantially resting upon the center base panel and an extended position substantially projecting outwardly from the lateral side edges of the center base panel, said flexible hinge means also for flexibly connecting said side torso flap members to said center base panel for rolling of the interconnected center base panel and overlying side flap members disposed in said, folded, storage position in the longitudinal direction of the center base panel into a tight cylindrical roll condition for storage and transport, said tight cylindrical roll condition containing said side torso flap members therein and having an overall cylinder length substantially equal to the width of the center base panel defined by said opposite lateral side edges thereof, d) flexible torso strap members releasably and adjustably interengaging the opposite side torso flap members for overlying the torso of a person positioned in a reclining condition on the center base panel and for cinchably drawing the opposite side torso flap members toward each other against the sides of the torso of a person to protectively secure the person on the stretcher, and e) a hand grasp member associated with the longitudinal head end of the center base panel for grasping by a rescuring person to facilitate the dragging of the stretcher with an injured person secured thereon.

2. The drag stretcher of claim 1 wherein said flexible hinge means includes lengths of flexible cord material connecting the center base panel and each side torso flap member together at longitudinally spaced apart positions adjacent to and along the confronting edges of each side torso flap member and the center base panel.

3. The drag stretcher of claim 1 wherein said center base panel has a length selected to position said longitudinal base end adjacent the crotch area of a person positioned in a reclining condition on the center base panel, and said base end mounts, intermediate said lateral side edges, one end of a pair of groin straps configured for extension upwardly therefrom between the legs of the person for releasable connection at their opposite ends to the opposite side torso flap members whereby to secure a person against longitudinal movement off of the base longitudinal end of the center base panel during operation of the drag stretcher.

4. The drag stretcher of claim 1 wherein said center base panel has a selected length sufficient to underlie the entire length of the head, torso body portion, legs and feet of a person positioned in the reclining position thereon, and flexible leg strap members are configured to releasably interengage opposite lateral side edges of the center base panel underlying the legs of a person thereon for overlying and releasably and cinchably securing the legs in position on the center base panel during operation of the stretcher.

* * * * *